US005381865A

United States Patent [19]

Blandford

[11] Patent Number: 5,381,865

[45] **Date of Patent: * Jan. 17, 1995**

[54] METHOD AND APPARATUS FOR PRODUCTION OF SUBSEA HYDROCARBON FORMATIONS

[76] Inventor: Joseph W. Blandford, 15 Mott La., Houston, Tex. 77024

[ * ] Notice: The portion of the term of this patent subsequent to Jun. 2, 2009 has been disclaimed.

[21] Appl. No.: 2,473

[22] Filed: Jan. 8, 1993

Related U.S. Application Data

[63] Continuation-in-part of Ser. No. 891,953, Jun. 1, 1992, which is a continuation of Ser. No. 626,994, Dec. 13, 1990, Pat. No. 5,117,914.

[51] Int. Cl.[6] ..... B63B 35/44

[52] U.S. Cl. ..... 166/344; 166/352; 166/354

[58] Field of Search ..... 166/341, 342, 343, 344, 166/345, 352, 353, 354, 366

[56] References Cited

U.S. PATENT DOCUMENTS

| | | | |
|---|---|---|---|
| 3,401,746 | 9/1968 | Stevens | 166/352 |
| 3,982,401 | 9/1976 | Loggins | 166/352 X |
| 4,556,340 | 12/1985 | Morton . | |
| 4,727,819 | 3/1988 | Pollack | 166/354 |
| 4,740,109 | 4/1988 | Horton . | |
| 4,754,817 | 7/1988 | Goldsmith | 166/353 X |
| 4,762,180 | 8/1988 | Wybro et al. . | |
| 4,784,529 | 11/1988 | Hunter . | |
| 5,117,914 | 6/1992 | Blandford . | |

OTHER PUBLICATIONS

U.K. Patent No. 2,250,767 Shell Dec. 1990.

Gulf of Mexico Newsletter Aker Omega SCBR Aug. 1991.

*Primary Examiner*—William P. Neuder

*Attorney, Agent, or Firm*—Gunn & Kuffner

[57] ABSTRACT

A system for controlling, separating, processing and exporting well fluids produced from subsea hydrocarbon formations is disclosed. The subsea well tender system includes a surface buoy supporting one or more decks above the water surface for accommodating equipment to process oil, gas and water recovered from the subsea hydrocarbon formation. The surface buoy includes a surface-piercing central flotation column connected to one or more external floatation tanks located below the water surface. The surface buoy is secured to the seabed by one or more tendons which are anchored to a foundation with piles imbedded in the seabed. The system accommodates multiple versions on the surface buoy configuration.

16 Claims, 17 Drawing Sheets

FIG. 2
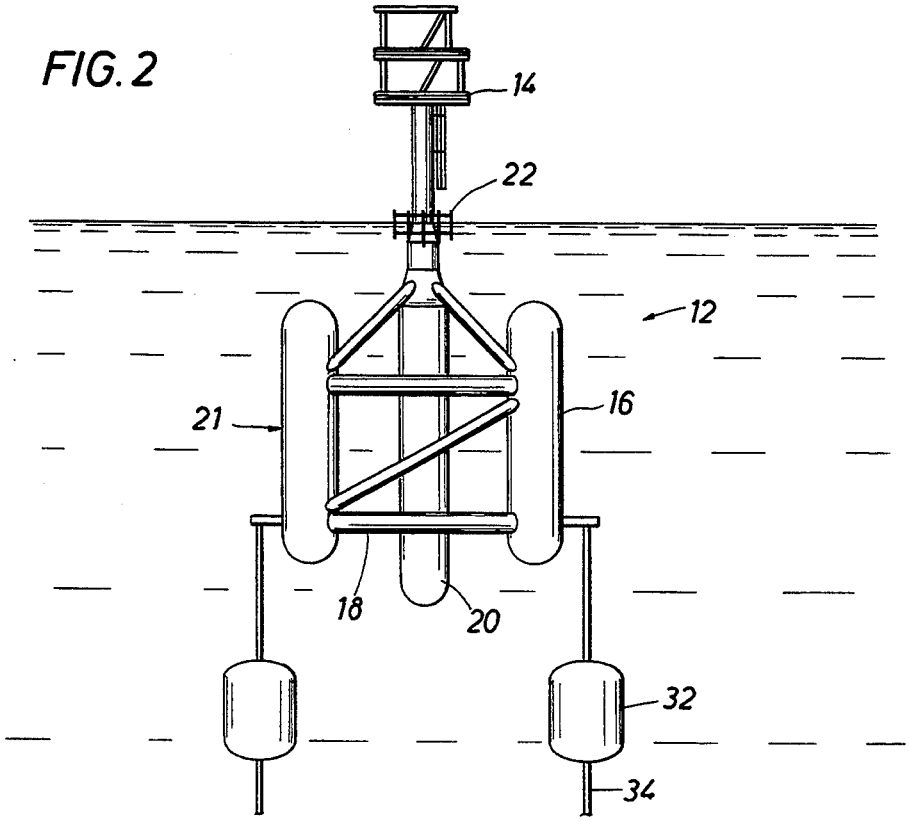
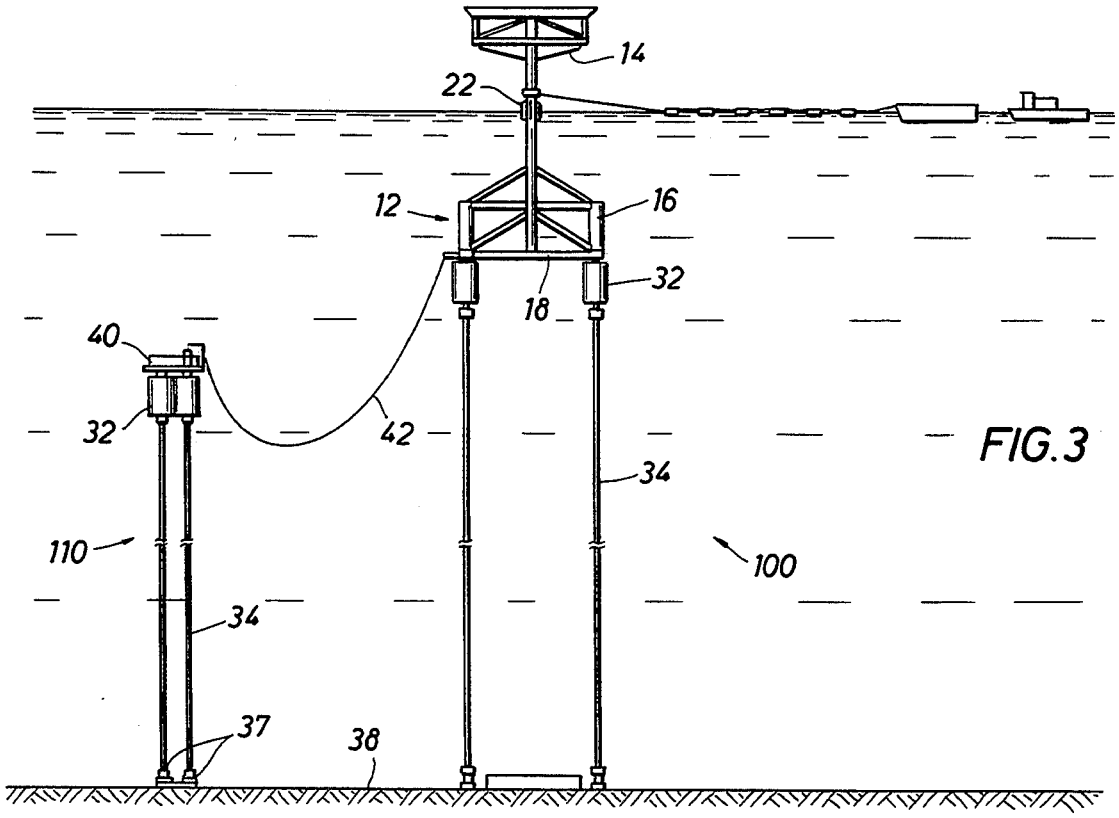
FIG. 3

METHOD AND APPARATUS FOR PRODUCTION OF SUBSEA HYDROCARBON FORMATIONS

This invention was made with Government support under contract No. DE-FG02-90ER80888 awarded by the Department of Energy. The Government has certain rights in this invention.

RELATED APPLICATIONS

This application is a continuation-in-part application of U.S. patent application Ser. No. 07/891,953 filed Jun. 1, 1992, which is a continuation application of U.S. patent application Ser. No. 07/626,994 filed Dec. 13, 1990, now U.S. Pat. No. 5,117,914, issued Jun. 6, 1992.

BACKGROUND OF THE DISCLOSURE

The present invention is directed to a method and apparatus for testing and producing hydrocarbon formations found in deep (over 300 feet) offshore waters, particularly to a method and deep water system for economically producing relatively small deep water hydrocarbon reserves which currently are not economical to produce utilizing conventional technology.

Commercial exploration for oil and gas deposits in U.S. domestic waters, principally the Gulf of Mexico, is moving to significantly deeper waters (over 300 feet) as shallow water reserves are being depleted. Deep water exploration is usually undertaken only by major oil companies, due to its very high cost. The major oil companies must discover very large oil and gas fields with large reserves to justify the large capital expenditure needed to establish commercial production. The value of these reserves is further discounted by the long time required to begin production using current technology. As a result, many smaller or "lower tier" offshore fields are deemed to be uneconomical to produce. The economics of these deep water small fields can be significantly enhanced by improving and lowering the cost of methods and apparatus to produce hydrocarbons from them.

In water depths up to about 300 feet, in regions where other oil and gas production operations have been established, successful exploration wells drilled by jack-up drilling units are routinely completed and produced. Such completion is often economically attractive because bottom founded structures can be installed to support the surface-piercing conductor pipe left by the jack-up drilling unit. Moreover, in a region where production operations have already been established, available pipeline capacities are relatively close, making pipeline hook-ups economically viable.

Significant hydrocarbon discoveries in water depths over about 300 feet are typically exploited by means of centralized drilling and production operations that achieve economies of scale. These central facilities are costly and typically require one to five years to plan and construct. To economically justify such central facilities, sufficient producible reserves must be proven prior to committing to construction of a central facility. Depending on geological complexity, the presence of commercially exploitable reserves in water depths of 300 feet or more is verified by a program of drilling and testing a number of expendable exploration and delineation wells, typically 4 to 12 wells. The total period of time from drilling a successful exploration well to first production from a central drilling and producing platform typically ranges from two to ten years.

A complete definition of the reservoir and its producing characteristics is not available until the reservoir is produced for an extended period of time, typically one or more years. However, it is necessary to design and construct the producing facility several years before the producing characteristics of the reservoir are precisely defined. This often results in facilities with either excess or insufficient allowance for the number of wells required to efficiently produce the reservoir and excess or insufficient plant capacity at an offshore location where modifications are costly.

Early production and testing systems have been used in the past by converting Mobil Offshore Drilling Units ("MODU's"). A drilling unit is overkill for early production of less prolific wells and when the market tightens, such conversions may not be economical. Similarly, converted tanker early production systems, heretofore used because they were plentiful and cheap, can also be uneconomic for less prolific wells. The system of the present disclosure efficiently and economically supports a production operation, whereas a MODU is intended for drilling and a tanker system for transportation of hydrocarbons.

As noted in Morton U.S. Pat. No. 4,556,340, floating hydrocarbon production facilities have been utilized for development of marginally economic discoveries, early production and extended reservoir testing. Floating hydrocarbon production facilities also offer the advantage of being easily moved to another field for additional production work and may be used to obtain early production prior to construction of permanent, bottom founded structures. Floating production facilities have heretofore been used to produce marginal subsea reservoirs which could not otherwise be economically produced. In the aforementioned U.S. Pat. No. 4,556,340, production form a subsea wellhead to a floating production facility is realized by the use of a substantially neutrally buoyant flexible production riser which includes biasing means for shaping the riser in an oriented broad arc. The broad arc configuration permits the use of wire line well service tools through the riser system.

In Hunter U.S. Pat. No. 4,784,529 a mooring apparatus and method for securely mooring a floating tension leg platform to an anchoring base template is disclosed. The method includes locating a plurality of anchoring means on the seabed, the anchoring means being adapted for receipt of a mooring through a side entry opening in the anchoring means. A semi-submersible floating structure is stationed above the anchoring means for connection thereto by the mooring tendons.

An FPS (Floating Production System) consists of semi-submersible floater, riser, catenary mooring system, subsea system, export pipelines, and production facilities. Significant system elements of an FPS do not materially reduce in size and cost with a reduction in number of wells or throughput. Consequently, there are limitations on how well an FPS can adapt to the economic constraints imposed by marginal fields or reservoir testing situations. The cost of the semi-submersible vessel (conversion or newbuild) and deepwater mooring system alone would be prohibitive for many of these applications.

Note that the semi-submersible configuration was developed for drilling applications. Here a large amount of payload must be supported with low free-floating motions. In marginal field applications neither requirement is important. In the present invention, only small payloads are required and these can be supported on a small deck which can be supported by a centrally located single surface-piercing column, rather than four corner located surface-piercing columns. Low free-floating motions are not required because a permanent vertical tension mooring will restrain vertical motions. As the need for large waterplane area is reduced, the structure in the wave zone can become more transparent, reducing environmental load and cost.

A TLP (Tension Leg Platform) consists of a four column semisubmersible floater, multiple vertical tendons on each corner, tendon anchors, and well risers. A single leg TLP has four columns and a single tendon/well. The TLP deck is supported by four columns that pierce the water plane. TLP's typically bring well(s) to the surface for completion.

As the TLP size is reduced, and the distance between corners diminishes, yaw motions increase and lead to interference between well risers. They twist around each other thereby creating a potential safety hazard with well risers. In the case of a single leg TLP, a catenary mooring is required to prevent large twisting displacements. The deepwater catenary mooring is a substantial additional cost element.

There are limitations on the extent to which a TLP can be reduced in size and cost. No matter how small the TLP's payload, it must contain enough buoyancy to keep sufficient pre-tension on tendons so that tendons never go slack as a wave trough passes. A slack tendon can snap to very high tension loads that cause high fatigue damage or overstress.

A further restriction in shrinking a TLP is the fact that during tow and installation, the TLP's stability depends on water plane area. This limits how close together the columns can be spaced. After the TLP's tendons are in place, the tendon tension stabilizes the TLP and it need not be stable in the free floating condition. A conventional TLP has at least three columns that pass through the water surface and attract environmental load. This is three times as much column wind area and load as the system configuration of the present disclosure.

SUMMARY OF THE INVENTION

The present invention provides a system for controlling and processing well fluids produced from subsea hydrocarbon formations. The subsea well tender system includes a surface buoy supporting one or more decks above the water surface for accommodating equipment to process oil, gas and water recovered from the subsea hydrocarbon formation. The surface buoy includes a surface-piercing central flotation column connected to one or more external floatation tanks located below the water surface. The surface buoy is secured to the seabed by one or more tendons which are anchored to foundation piles imbedded in the seabed.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is an elevational side view of the surface-piercing buoy of the well tender system of the invention;

FIG. 3 is an elevational environmental view showing an alternate embodiment of the well tender system of the invention;

DETAILED DESCRIPTION OF THE INVENTION

The well tender system of the present disclosure may be adapted for various configurations. Depending on the conditions and facilities at the well site, the system may or may not require oil storage. The system may also be installed, temporarily or permanently, directly above a well.

Figure 1:
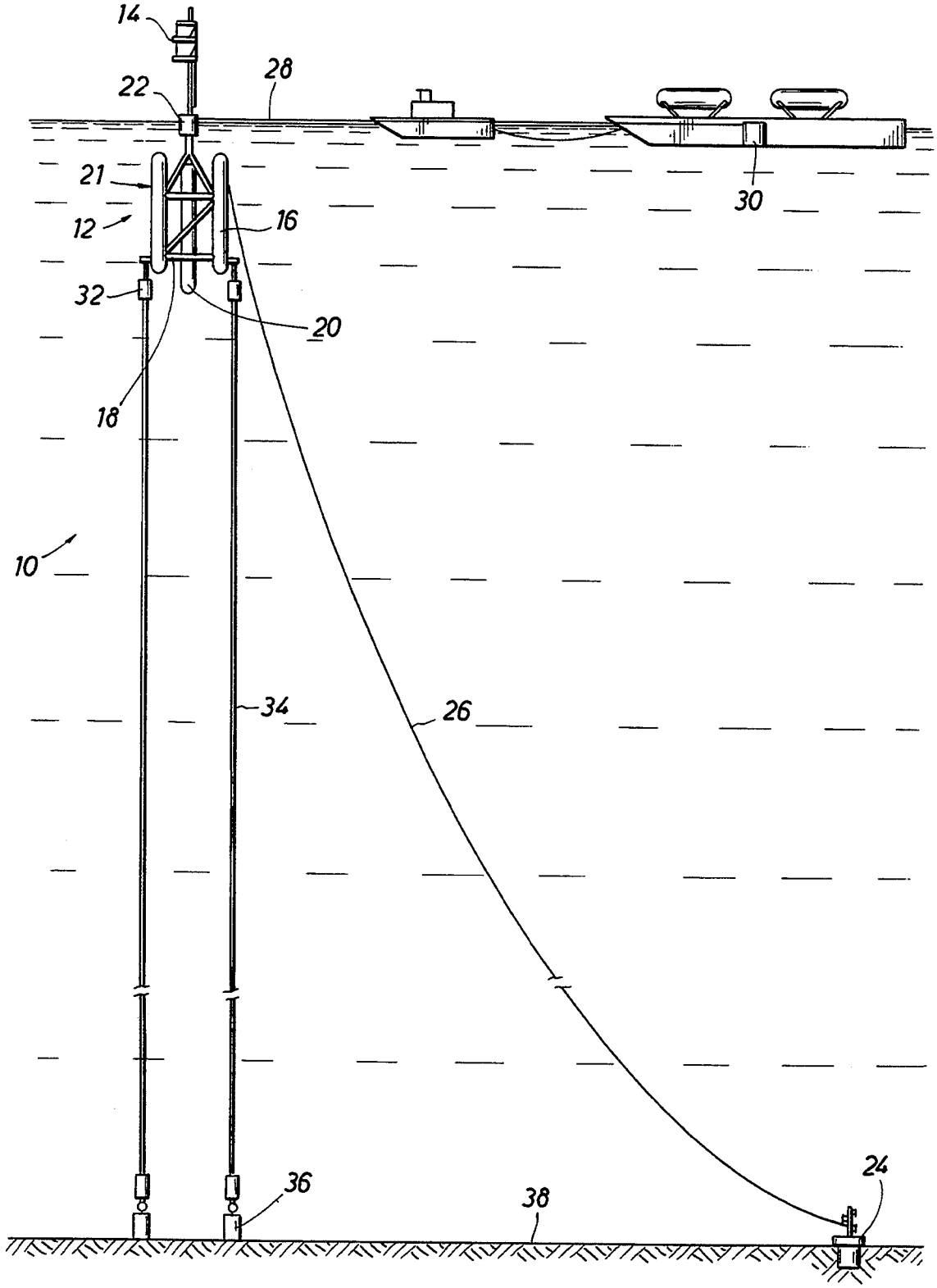
FIG. 1 is an elevational environmental view showing the well tender system of the present invention.

Referring first to FIG. 1, the well tender system of the invention is generally identified by the reference numeral 10. The well tender system 10 includes a surface-piercing buoy 12 which provides positive buoyancy and vertical support to the entire tender system 10 of the invention and supports the production deck 14 which is large enough to accommodate the equipment necessary to control and process the oil, gas and water produced from the subsea reservoir.

The surface-piercing buoy 12 includes one or more submerged tanks 16 fabricated of steel or other material. The size, number, and composition of the tanks 16 depends on the application. The tank cross-section can be circular, rectangular or any other suitable shape as required. The tanks 16 are incorporated into a framework of steel braces 18 that are themselves buoyant, and as a unit the braces 18 comprise the substructure portion of the surface-piercing buoy 12. At the center of the buoy 12 is a central flotation column 20 extending from the bottom of the buoy 12, up through the water surface and up to the production decks 14. The tanks 16, steel braces 18, and flotation column 20 form the hull 21 component of the surface-piercing buoy 12.

The large diameter central flotation column 20 supports the production decks 14, which may include one or more decks, and the equipment. A boat landing 22 is attached to the column 20 at the waterline, and it may extend partially or completely around the central column 20. The superstructure of the surface-piercing buoy 12 comprises one or more decks, and is constructed of steel or other materials, as applicable, to accommodate the equipment required to control, process, compress, and inject the fluids, gas or liquid, produced by any particular reservoir. For example, the surface-piercing buoy 12 may include a helideck and one or more decks which may accommodate simple test equipment, and/or full processing equipment.

The central flotation column 20 is compartmentalized for damage control. It includes a ballast manifold with a submersible electric pump (not shown in the drawings) to deballast the hull during installation. The electric pump may be a type commercially available, for example, a submersible pump manufactured by Reda. The central column 20 may range in size from three feet to fifty feet in diameter depending upon the application, and the diameter of the column 20 may vary. The bottom of the central column 20 may extend as deep as 250 ft. below the water surface, and it will extend up to the lower deck elevation. Likewise, the flotation tanks 16 are compartmentalized for damage control. The ballast compartments of the tanks 16 are piped to be drained by the submersible pump in the central column 20.

Well fluids are conducted from the remote wells 24, up one or more flowline risers 26 to the production deck 14, where the well fluids are injected into equipment for processing. Multiple flowline risers 26 may be bundled or may extend up to the surface individually, as desired by the operator. Each riser 26 is in the form of a catenary line and may be comprised of flexible or rigid material. The catenary risers 26 may also provide a restoring torque that aids to stabilize the vertical mooring system of the invention. Depending on water depth and corresponding water temperature, the flowline risers 26 may be insulated to maintain flowline temperature to inhibit hydrate formation.

The risers 26 extend from each remote well 24 to the surface-piercing buoy 12 and are equally sized permitting pigging of the flowlines from the production deck 14. It is operationally desirable for each well 24 to have an individual flowpath from the subsea well 24 to a flow control choke at the production deck 14. For gas wells it is operationally desirable to have a means to carry hydrate control chemicals to the well 24.

A separate service riser bundle 28 extends from the surface buoy boat landing 22 through a catenary or floating hose to a pick-up buoy 30 that allows the production system to be serviced and off-loaded. In the absence of a liquid pipeline, produced oil can be off-loaded by one or more vessels keeping station in a watch circle around the surface buoy 12. Oil may also be stored and off-loaded from the tanks 16 or oversized tendon buoys 32 equipped with double hull or storage compartment tanks. It is also possible to off-load well fluids directly to the shuttle vessel.

Figure 5:
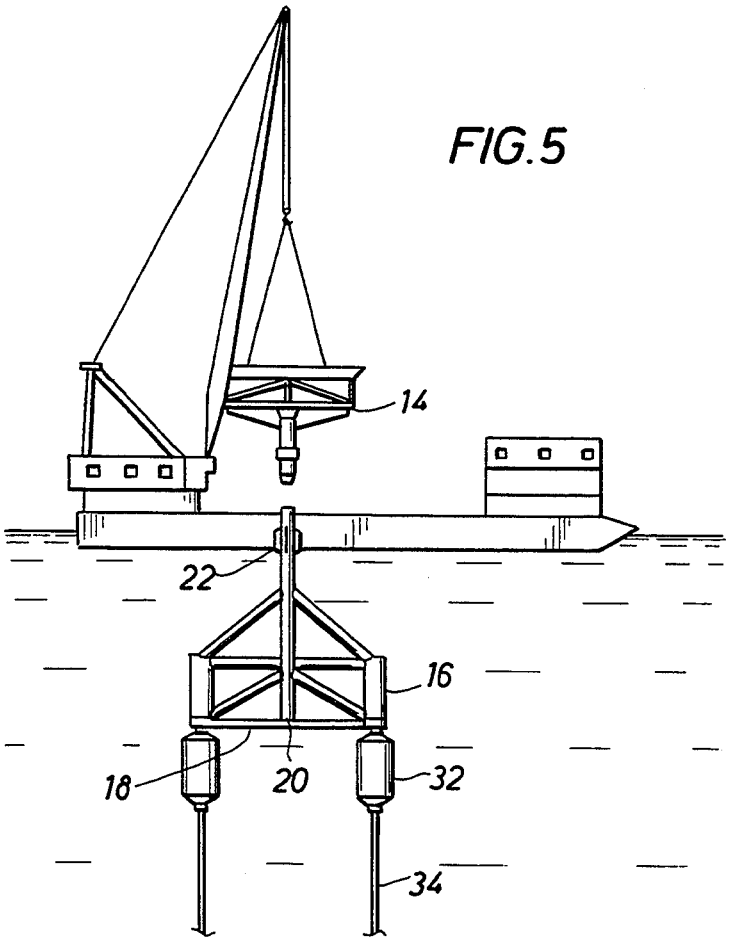
FIG. 5 is an elevational environmental view showing installation of the deck on the surface buoy of the invention.
Figure 6:
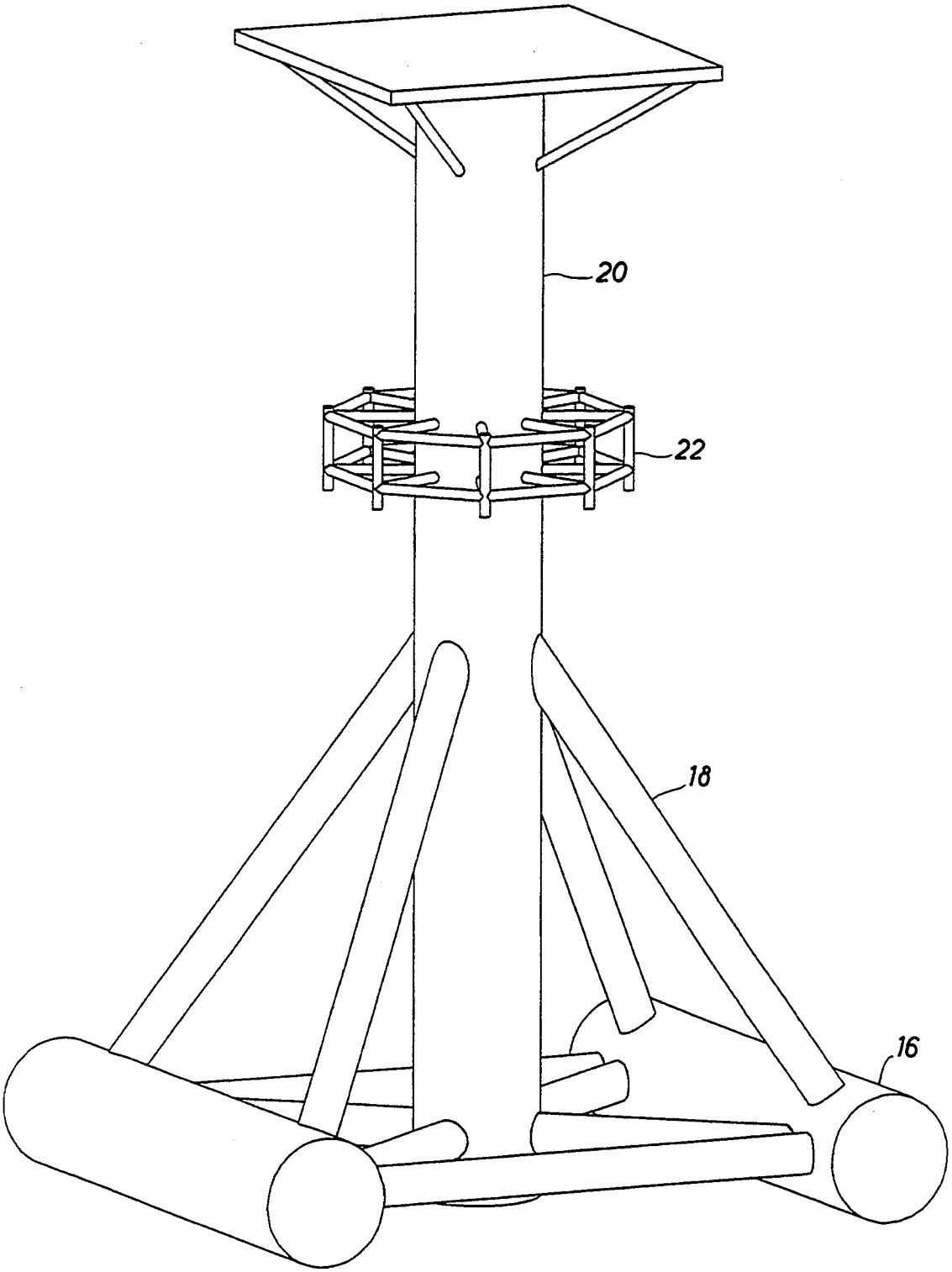
FIGS. 6–19 are elevational side views of various configurations of the surface buoy of the invention.
Figure 7:
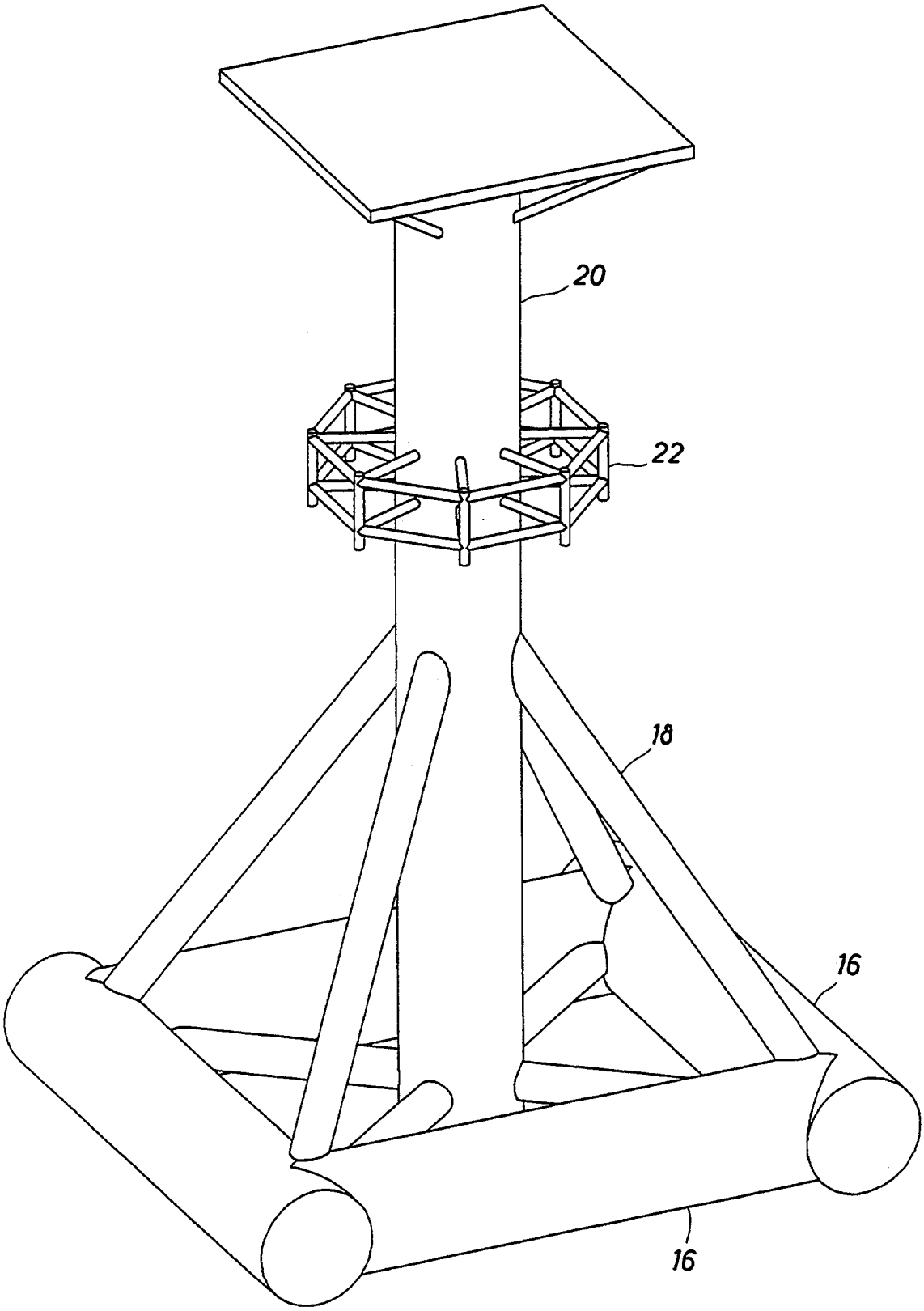

The surface buoy 12 shown in FIGS. 1 and 2 is installed at the offshore well site by controlled flooding of the central flotation column 20 and the tanks 16, causing the surface-piercing buoy 12 to be lowered in a vertical position for attachment to the top of the vertically positioned tendons 34 as shown in FIG. 5. Due to the light weight of the hull 21 and the absence of the production deck 14 at this stage of the installation, it is possible to lift the hull 21 from a transport barge with a small derrick barge. The ability of the derrick barge to apply upward force during lowering can stabilize the system if necessary. With the hull 21 in a ballasted condition, the upper ends of the tendons 34, which are anchored at the opposite ends thereof to the foundation 36, are connected to the hull 21 by a remote manually operated submerged vehicle and/or by divers. All ballast is then removed from the tanks 16 and the central flotation column 20. With the hull 21 securely in place, the deck section is then lifted from the cargo barge and set on the hull 21, thereby completing the installation of the well tender system 10 of the present disclosure.

The tendons 34 are connected either to the braces 12 or the tanks 16. Up to five connecting tendons 34 may extend from each brace 18 or tank 16 to the seabed 38. The tendons 34 may comprise single-piece tendons or multiple-piece tendons designed to be either neutrally buoyant or negatively buoyant. The tendons 34 are secured to the surface buoy 12 and the foundation 36 at the seabed 38 by means of a vertical stab connection or side-entry connection.

Referring now to FIG. 3, an alternate embodiment of the well tender system of the invention generally identified by the reference numeral 100 is shown. The well tender system 100 is substantially identical to the well tender system 10 previously described and therefore like reference numerals are employed to identify like components. It will be observed, however, that the surface buoy 12 shown in FIG. 3 is provided with tanks 16 which are smaller in external dimensions than the tendon buoys 32. The tendon buoys 32 are oversized to provide greater tensioning force to the tendons 34 and to reduce buoyancy requirements of the surface piercing buoy 12. Additionally, the oversized tendon buoys 32 may be equipped with storage compartments for storing recovered well fluids.

Referring still to FIG. 3, a near surface completion riser assembly generally identified by the reference numeral 110 is also shown. In this installation, risers 35 are connected to the wells 37 at the lower ends thereof. The riser buoys 39 provide sufficient upward tensioning force to maintain the risers 35 in a substantially vertical orientation. A manifold 40 may be supported by the riser buoys 39. Alternatively, the manifold 40 may be supported on the production deck 14. One or more flow line risers 42 extend from the manifold 40 to the surface buoy 12. In the installation shown in FIG. 3, well fluids are produced up the risers 35 and directed through the flow line risers 42 to the production deck 14 for processing.

Figure 4:
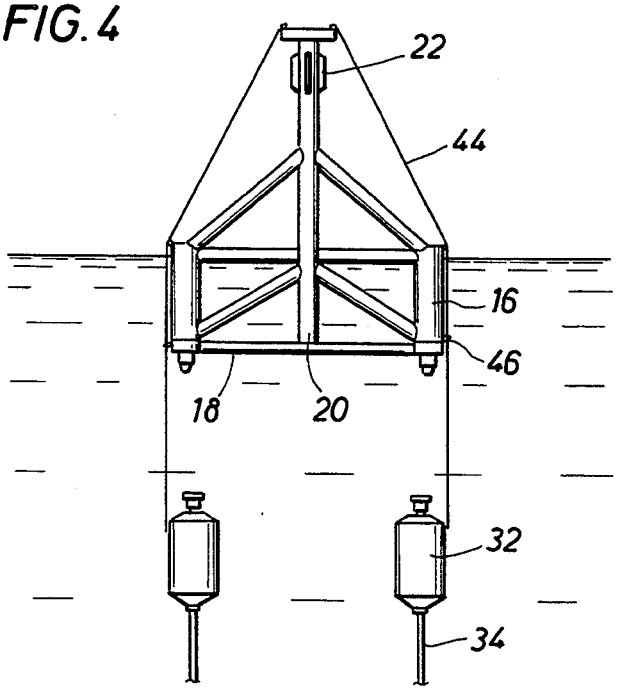
FIG. 4 is an elevational side view of the surface-piercing buoy of the alternate embodiment of the invention depicting the installation of the surface buoy on the tendons.

Referring now to FIGS. 4 and 5, the installation sequence of the surface buoy 12 and production deck 14 is shown. The installation of the surface buoy 12 has been previously described herein, however, with some installations it may be desirable to utilize guide lines to facilitate installation of the surface buoy 12 on top of the tendons 32. With this installation technique, guidelines 44 are attached to the top of the preinstalled tendon and reeved through sheaves on the hull 21 to winches located on the boat landing 22.

In the prior art, conventional semi submersible and TLP designs disclose a deck structure which is either integral with the hull or is mated with the hull. In either case, the dimensions of the deck are dictated by the dimensions of the hull, which in turn are influenced by floating and motion characteristics. The net effect is that the deck design is impacted not only by facilities but also by marine considerations.

In the well tender system of the present invention, the dimensions of the deck 14 are independent of the dimensions of the surface buoy hull. This not only simplifies the engineering of the deck 14 and the hull 21 by making them more independent, but also enables installation of different deck configurations and facilities on a single surface buoy hull configuration, thereby enhancing versatility and increasing reuse applications for a given surface buoy configuration. This versatility increases the salvage value of a surface buoy hull because not only may it be installed in different water depths, but it may be fitted with various deck configurations and facilities, provided only that the pay load carrying capacity of the surface buoy is not exceeded. In the well tender system of the present invention, the deck section can be installed on the hull 21 after the hull 21 is secured to the pre-installed tendons 34. This componentization simplifies the installation of the hull 21. Several ways are available to design the interface between the deck 14 and hull 21. For example, a single surface buoy hull 21 of the invention may accommodate a deck 14 which is prismatic in shape and connected at four corners to a small spider deck fabricated on the column 20 of the hull 21. Likewise, the same surface buoy hull 21 may accommodate a deck 14 which includes a section projecting therefrom which stabs into the surface piercing column 20 of the hull 21. In addition, the hull 21 may accommodate a prismatic shaped deck 14 which connects directly to the top of the surface piercing column 20 of the hull 21.

Figure 20:
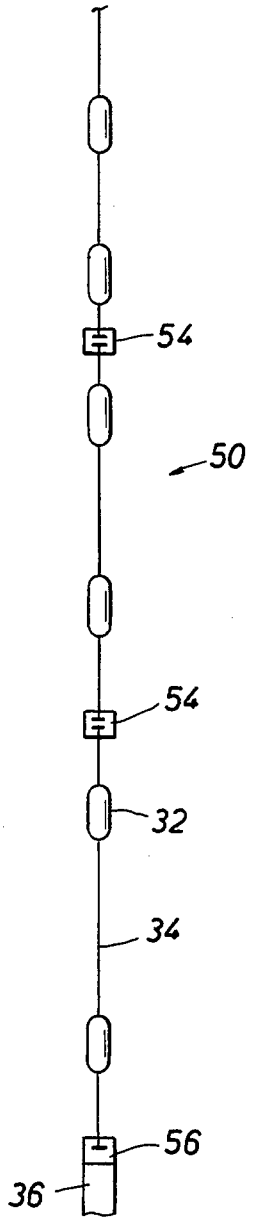
FIG. 20 is a side view showing stacking of tendon segments to form a single tendon string.

Referring now to FIG. 20, installation of a composite tendon generally identified by the reference 50 is shown. The composite tendon 50 is formed by a plurality of tendons 52 for installation in very deep water. However, few manufacturing yards have sufficient waterfront length to accommodate the fabrication of extremely long tendons. Also, the longer the tendons, the more difficult they are to upend to a vertical orientation. For example, Auger type tendons, approximately 240 feet long, typically are assembled on the side of a specially equipped derrick barge since the tendons do not have sufficient buoyancy to stand up by themselves. With the addition of buoyancy to the tendons, tendon lengths much longer than available cargo barges (240 feet) can be towed to the location, upended and lowered. By removing the ballast water from the tendon upper buoyancy tanks 32, the entire tendon string can be made self standing and can be released while the next tendon segment 52 is prepared for connection to the free floating tendon segments 32 which have been connected end to end by connectors 54. The connection 56 between the foundation pile 36 and the lower tendon segment 52 or between tendon segments may be of the Auger-style vertical stab, Joliet-style side entry, or the bottom entry type connection.

Figure 8:
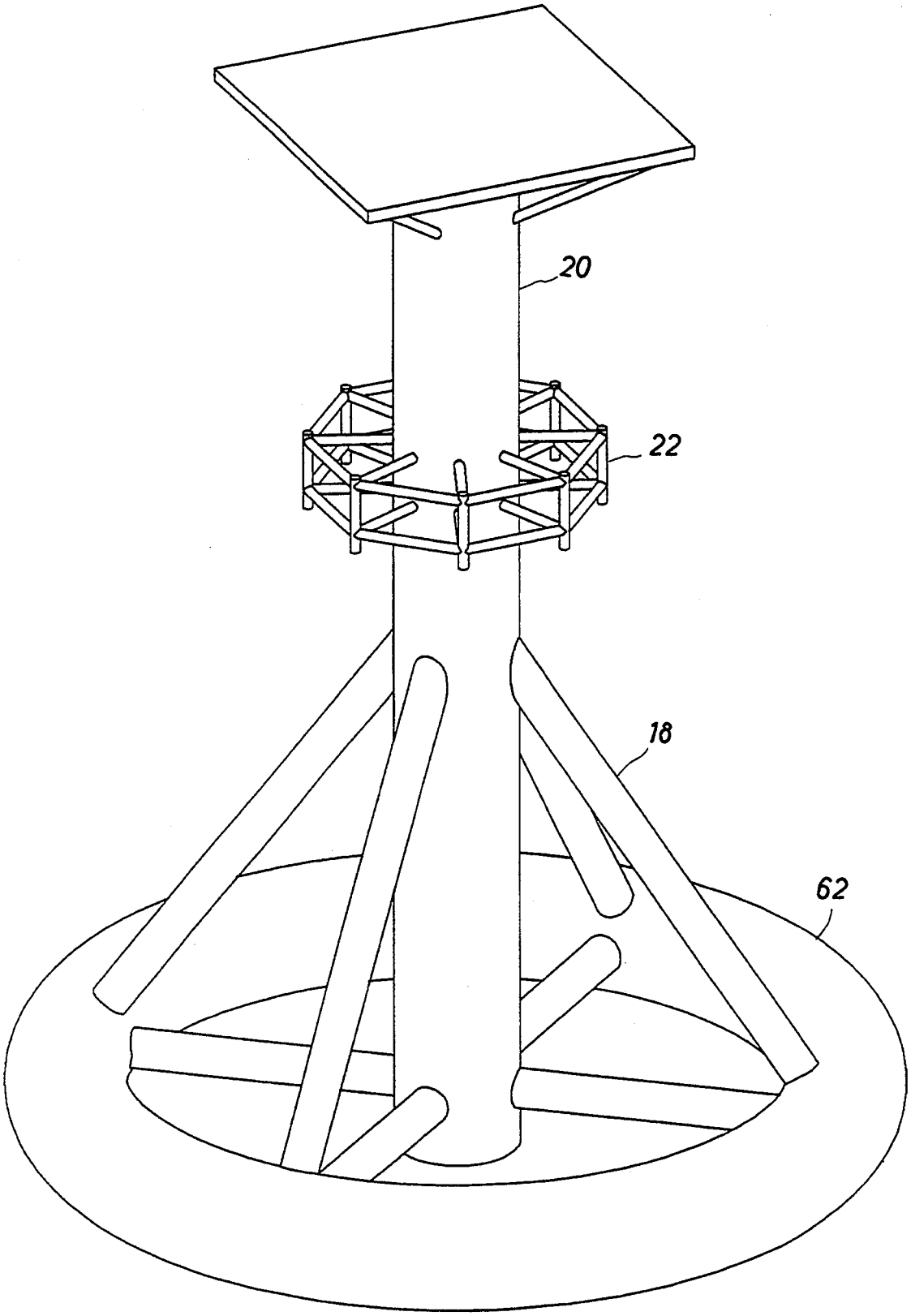
Figure 9:
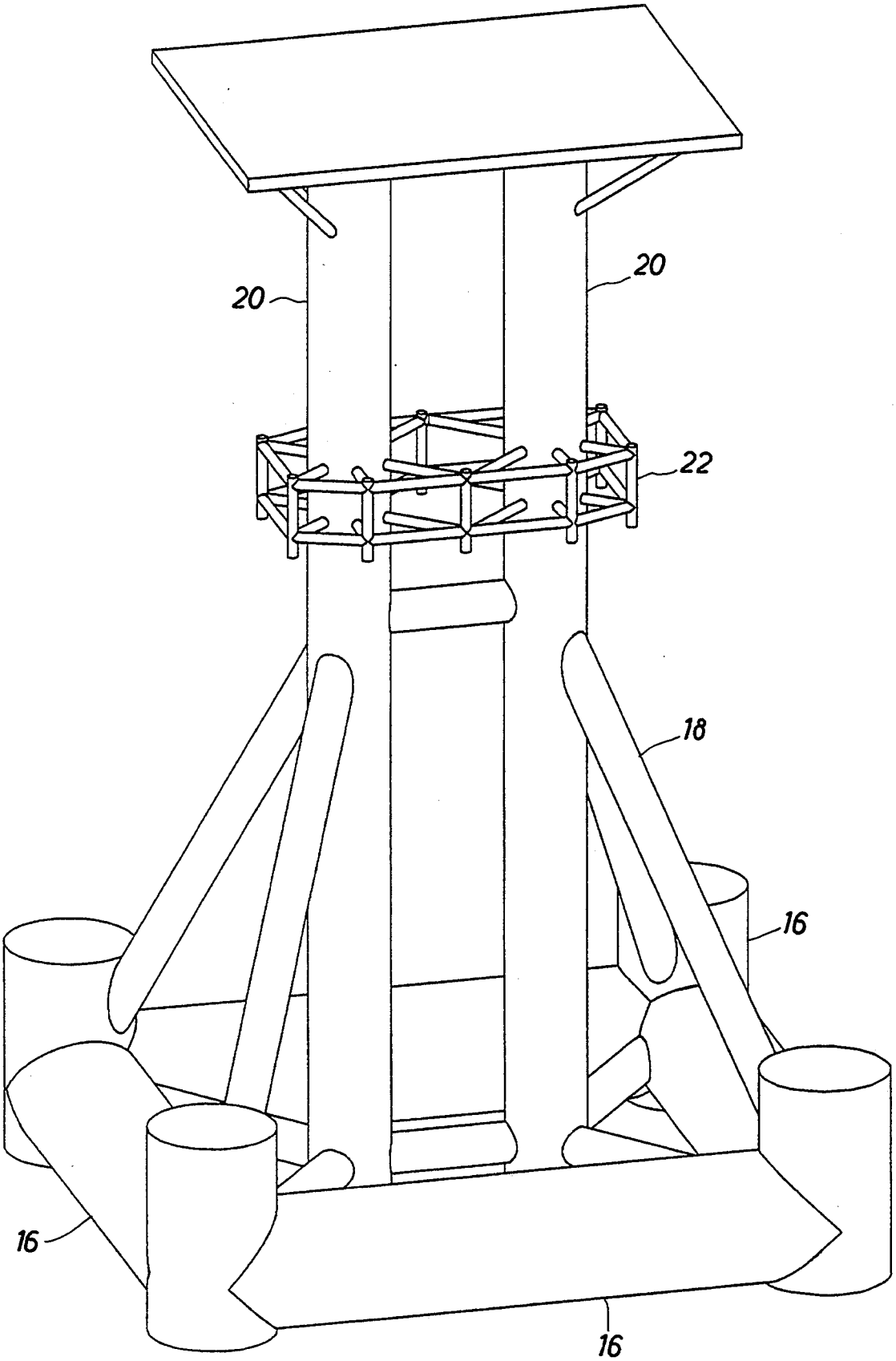
Figure 10:
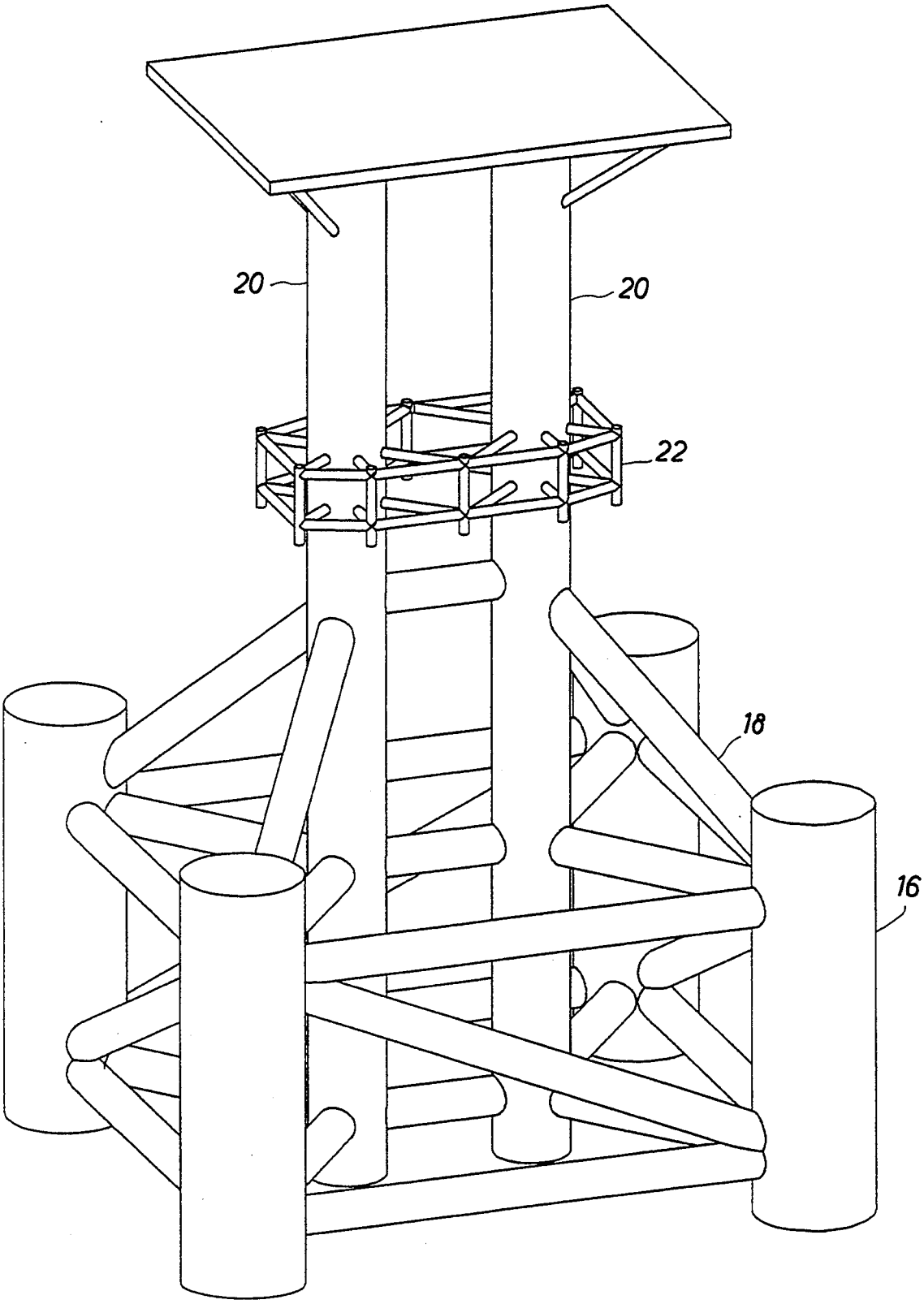
Figure 11:
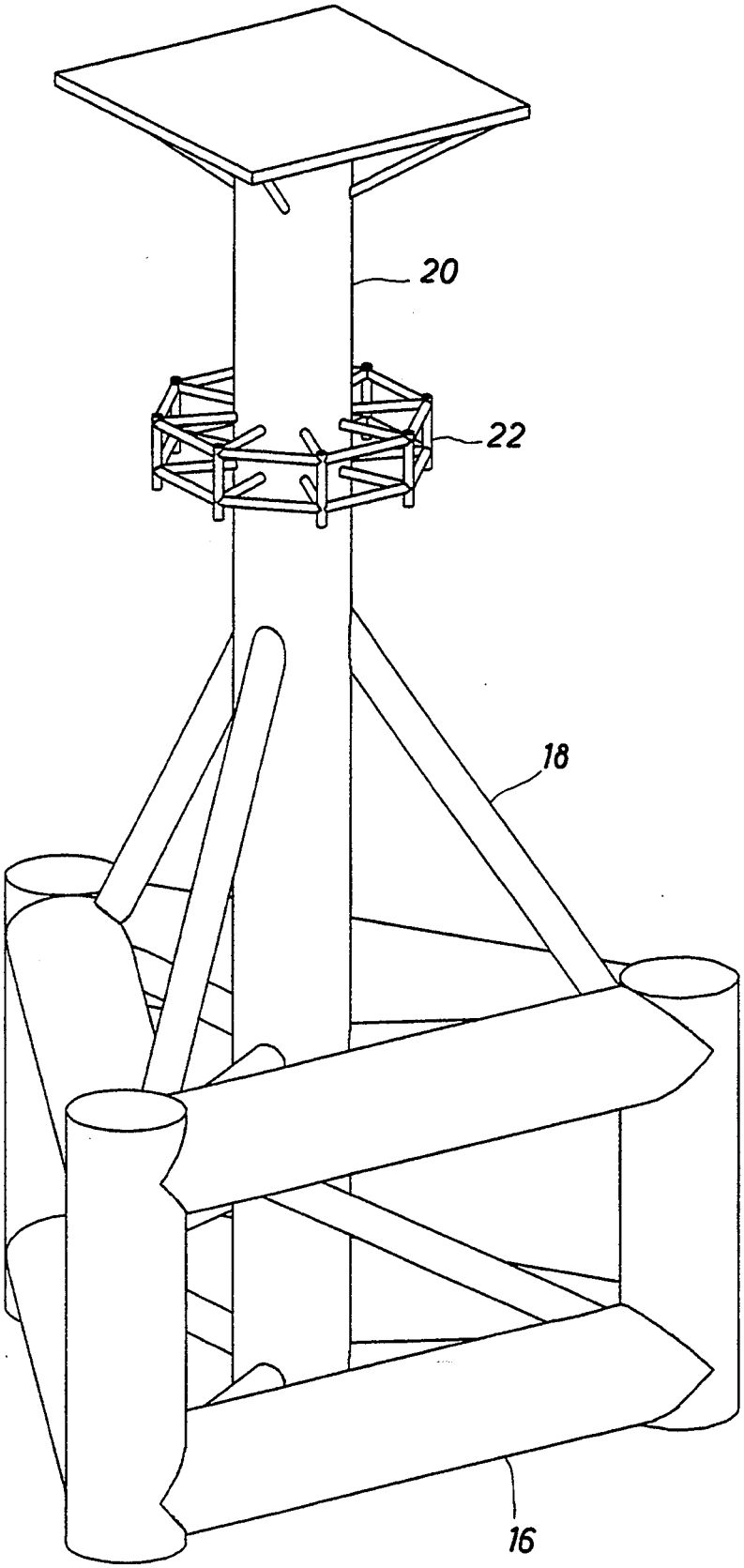
Figure 12:
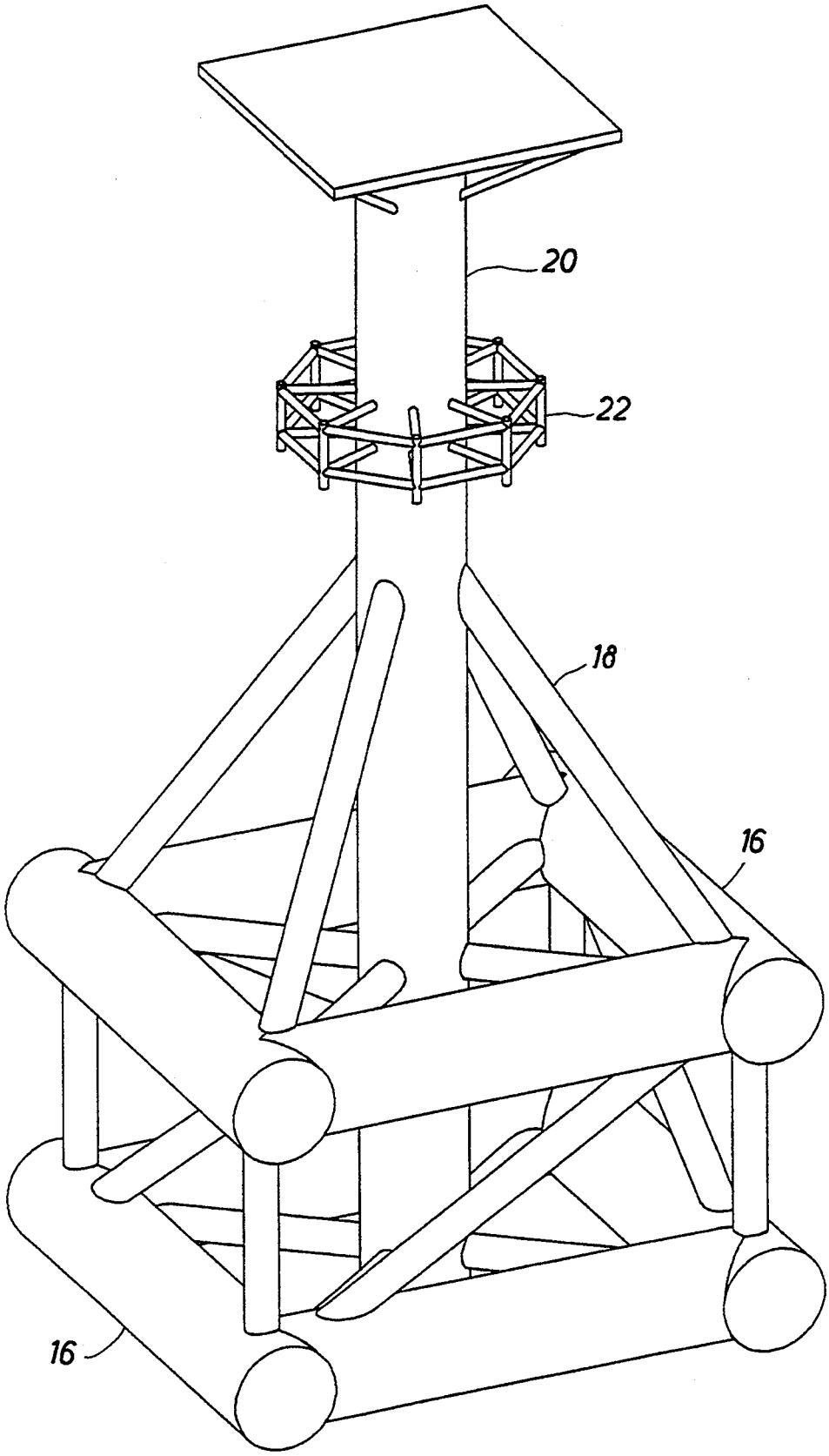
Figure 13:
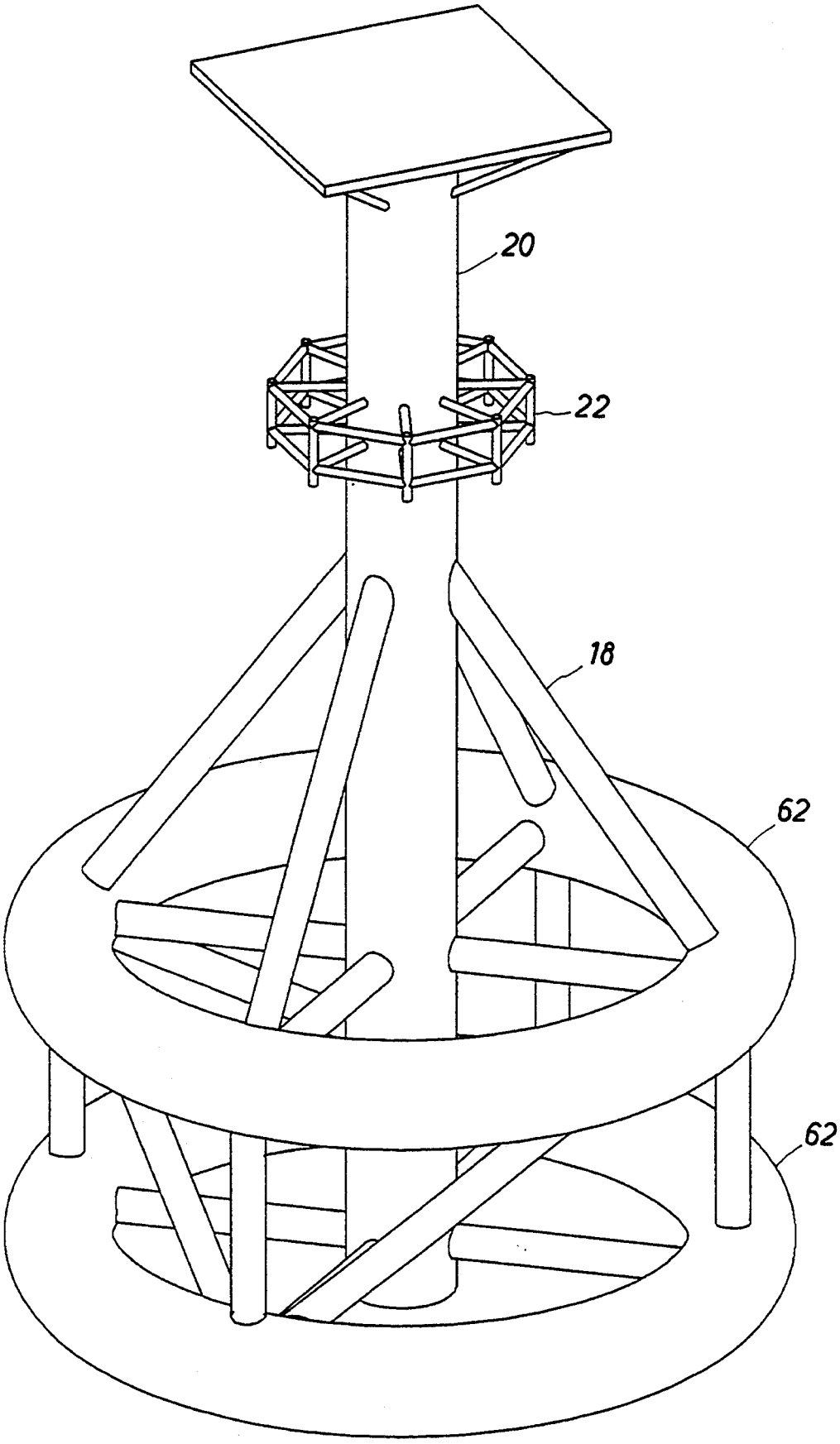
Figure 14:
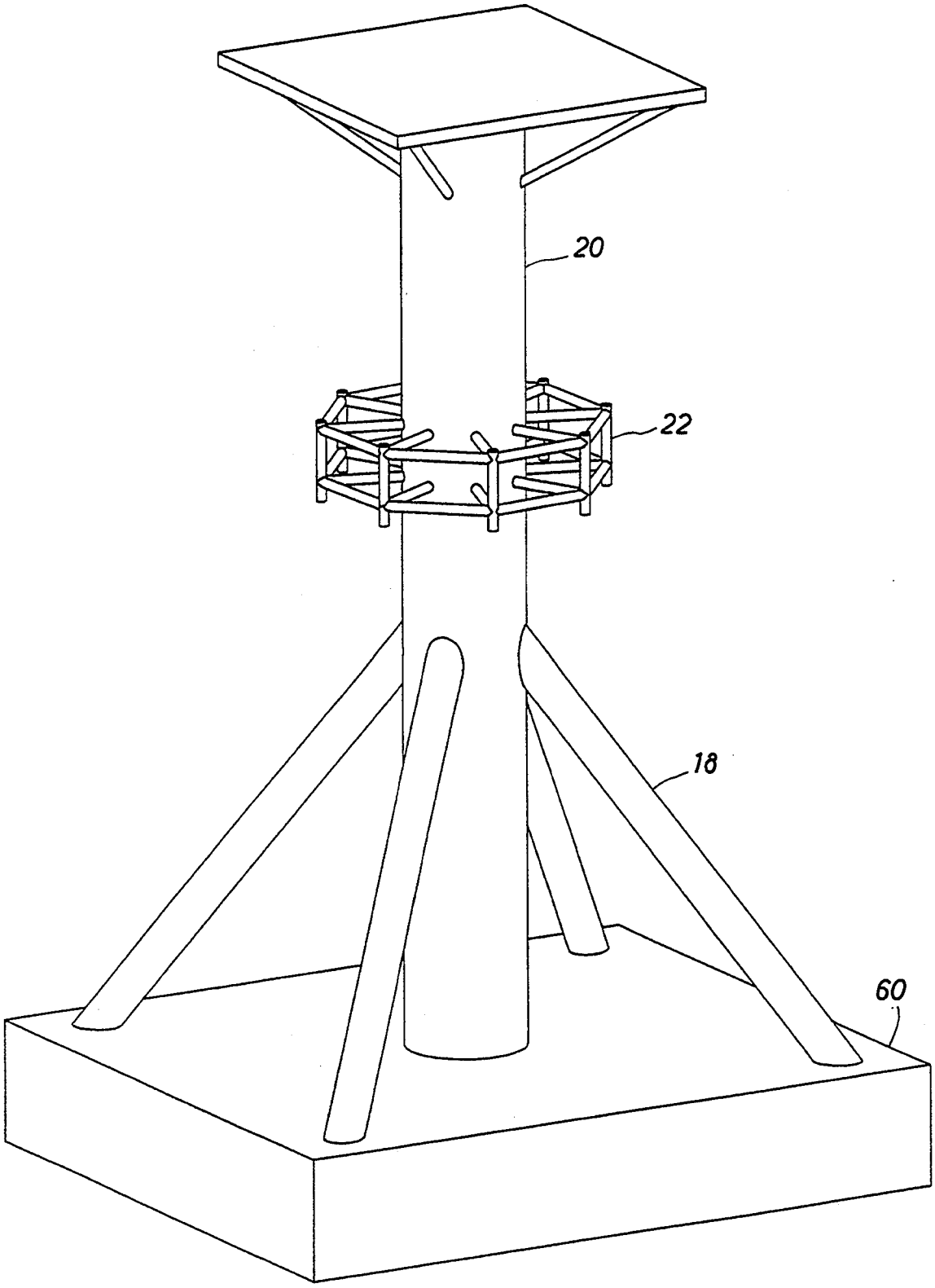
Figure 15:
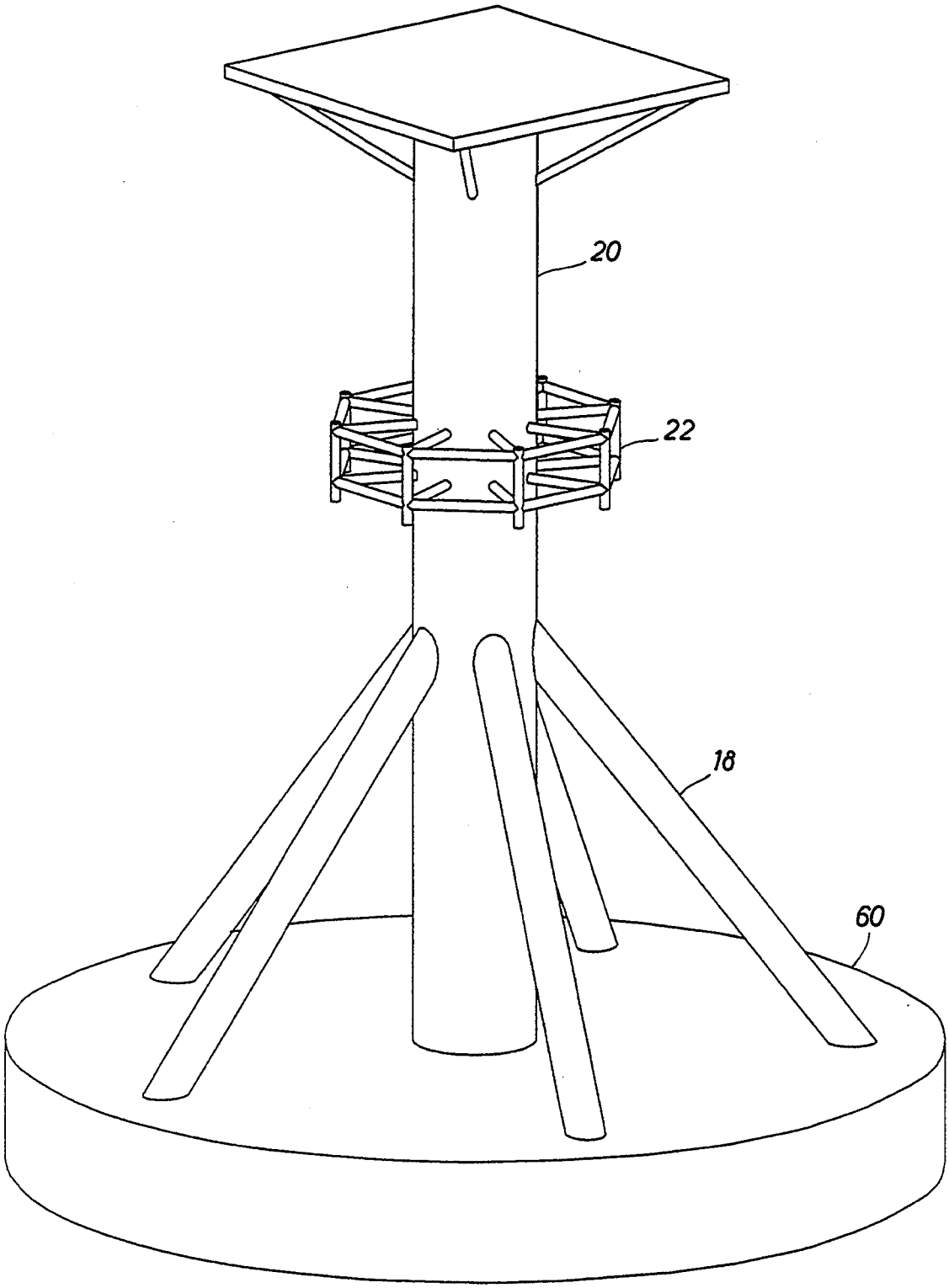
Figure 16:
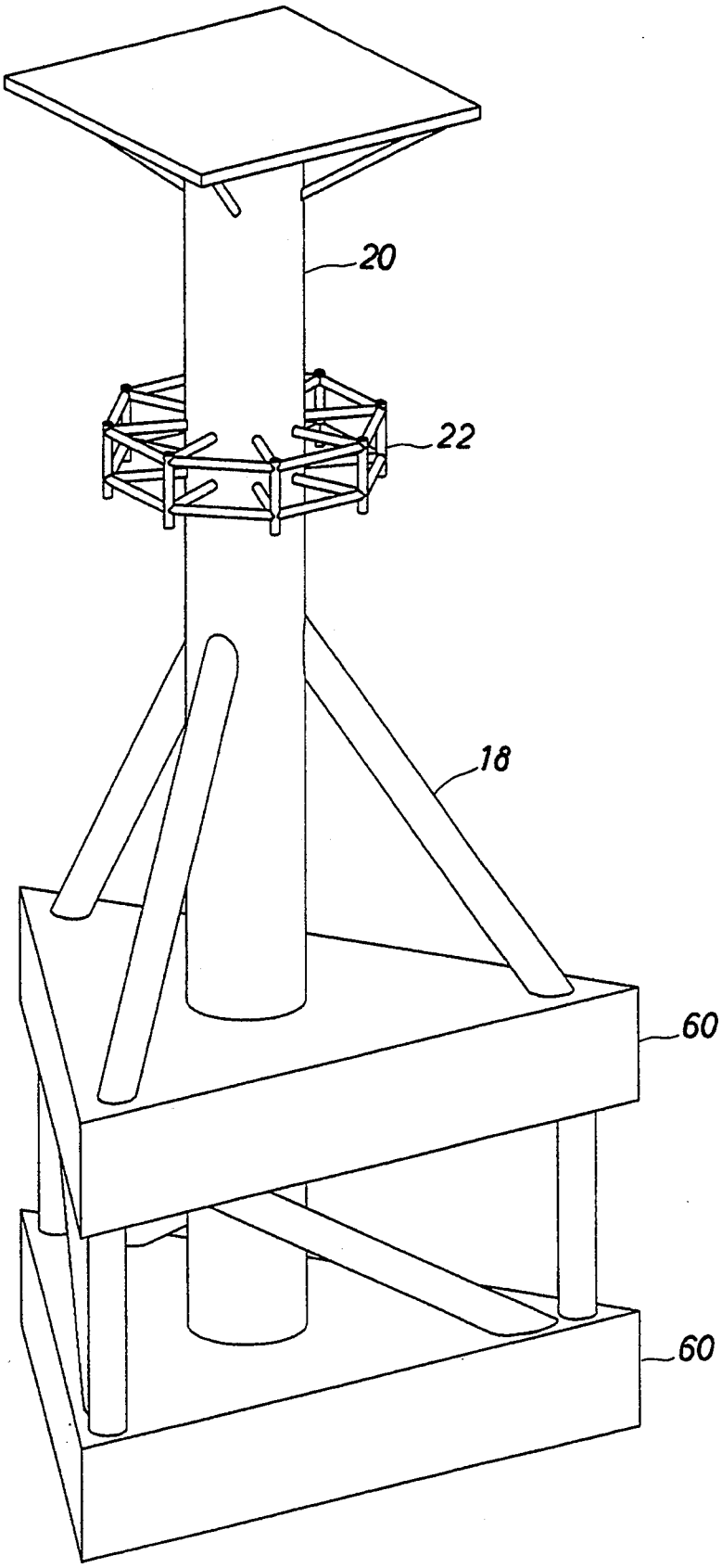
Figure 17:
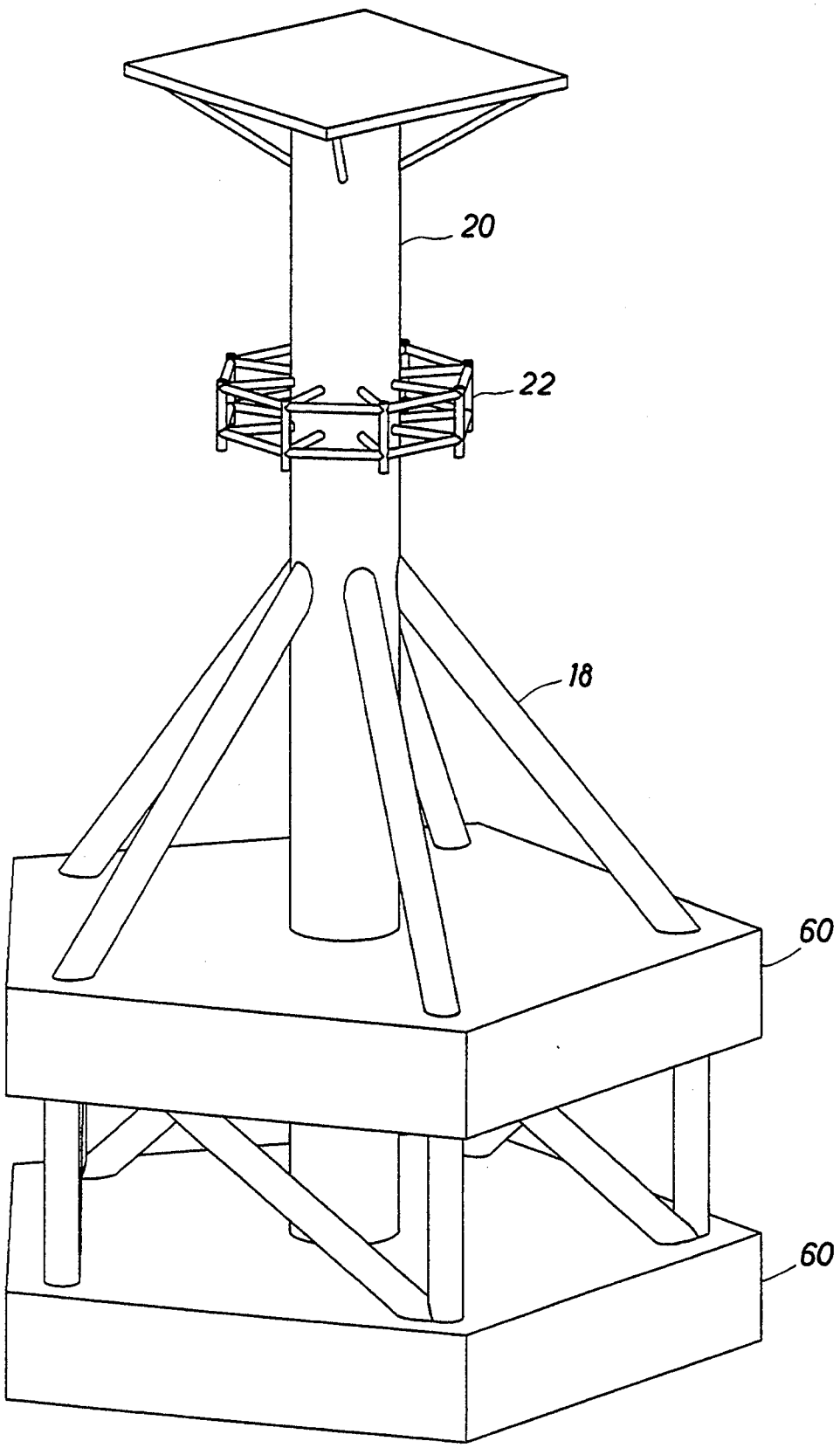
Figure 18:
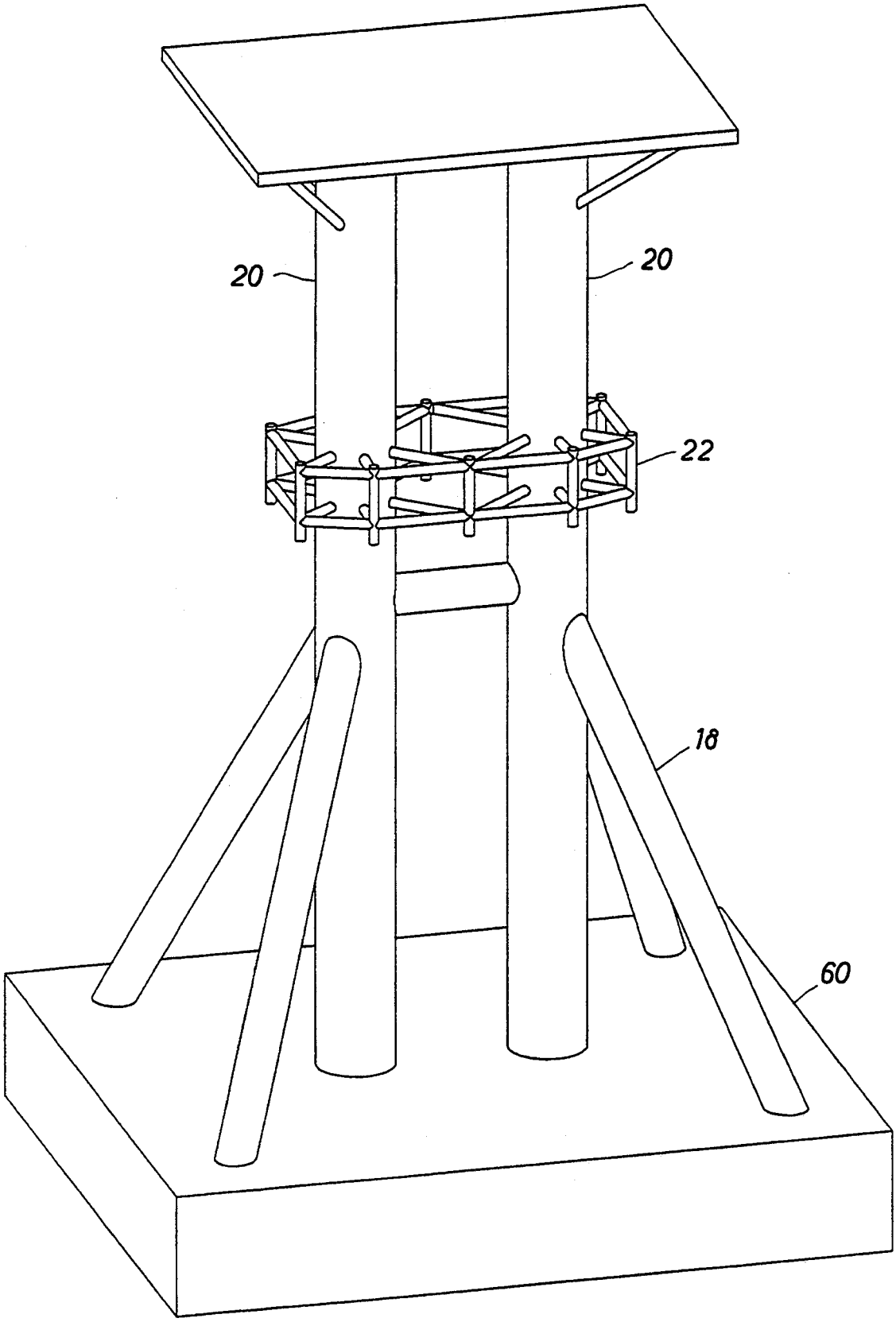
Figure 19:
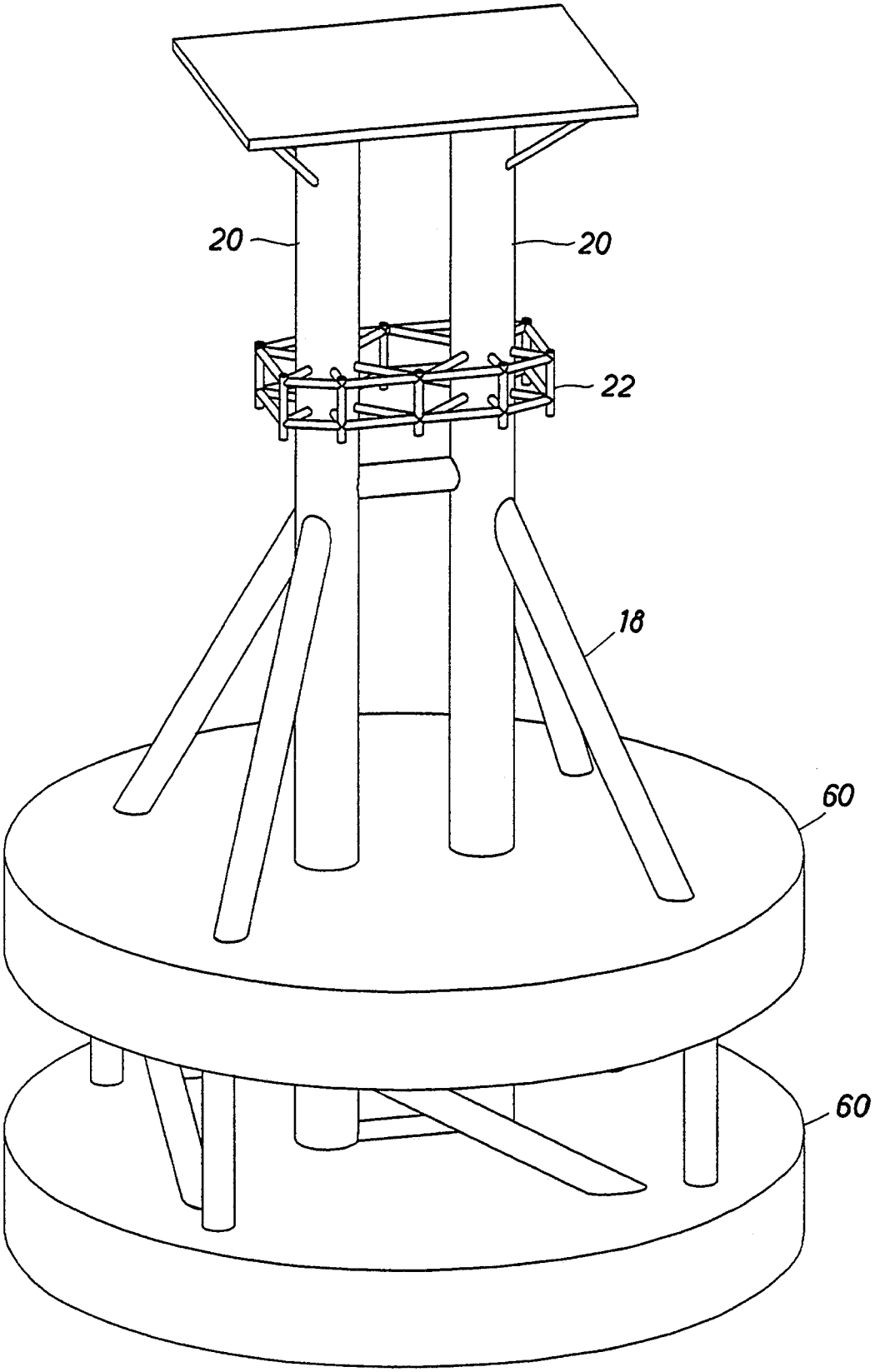

Referring now collectively to FIGS. 6–19, various configurations of the surface buoy 12 are shown. As noted above, the surface buoy 12 may include one or more submerged tanks 16 which may be configured to form multiple variations of the surface buoy 12 design. The variations include changing from solely "vertically oriented" to "horizontally oriented" flotation tanks 16. The number of horizontally or diagonally oriented flotation tanks 16 may vary from three to six. As the number of horizontal tanks 16 increases, the discrete tanks 16 evolve into a circular flotation ring 62, as more clearly shown in FIG. 8. In some instances it may be desirable to incorporate spaced and parallel central columns 20 as shown in FIGS. 9 and 10. This configuration is particularly useful for supporting increased payloads which may result from a design criteria requiring a complex production facilities. In addition, varying the number of plan levels, as shown in FIGS. 10–13, increases the buoyancy force and the payload capacity of the surface buoy 12 and can also add storage capacity. In addition, the flotation tanks 16 may be replaced by a solid buoyancy slab or tank 60 as shown in FIGS. 14–19. The shape of the solid buoyancy slab may also be varied, as well as the number of surface-piercing columns. In the variations of the surface buoy 12 shown in FIGS. 6 through 19, each corner of the particular configuration is anchored to the seabed 38 by one or more tendons 34.

While the foregoing is directed to the preferred embodiment of the present invention, other and further embodiments of the invention may be devised without departing from the basic scope thereof, and the scope thereof is determined by the claims which follow.

What is claimed is:

1. A subsea well tender system comprising a surface-piercing surface buoy, wherein said surface-piercing surface buoy supports one or more decks above the water surface for accommodating equipment to process oil, gas, and water, and further including anchoring means securing said surface buoy to the seabed.

2. The system of claim 1 wherein said surface buoy includes at least one surface-piercing flotation column for supporting one or more decks above the water surface, and further including at least one flotation tank mounted to said surface-piercing flotation column.

3. The system of claim 2 wherein said anchor means comprises at least two tendons having one end anchored to the seabed and the other end connected to said surface buoy.

4. The system of claim 3 wherein said tendons include a tendon flotation buoy adjacent to each end of said tendons, and wherein said uppermost tendon buoy is dimensionally larger than said flotation tanks.

5. The system of claim 1 wherein said surface buoy includes at least two vertically oriented flotation tanks.

6. The system of claim 1 wherein said surface buoy includes at least two horizontally oriented flotation tanks.

7. The system of claim 1 wherein said surface buoy includes at least two diagonally oriented flotation tanks.

8. The system of claim 1 wherein said surface buoy includes flotation tanks forming a circular flotation ring.

9. The system of claim 1 wherein said surface buoy includes at least two levels of flotation tanks spaced one above the other.

10. The system of claim 1 wherein said surface buoy includes at least two substantially centrally located surface-piercing columns.

11. The system of claim 1 wherein said surface buoy includes a solid buoyancy slab mounted at the lower end of the surface piercing column.

12. The system of claim 1 including a deck structure mounted on the surface-piercing column above the water surface.

13. The system of claim 12 wherein the deck structure defines a prismatic shape connected at four corners to a spider deck mounted on said surface-piercing column of said surface buoy.

14. The system of claim 12 wherein said deck structure includes a downwardly extending section for stabbing into the uppermost end of said surface-piercing column.

15. The system of claim 12 wherein said deck structure defines a prismatic shape adapted for connection onto the top of said surface-piercing column.

16. The system of claim 1 wherein said anchoring means comprises a plurality of tendon segments connected end to end to form a single tendon string extending from the seabed to said surface buoy.

* * * * *